United States Patent [19]

Kulprathipanja

[11] Patent Number: 5,000,794

[45] Date of Patent: Mar. 19, 1991

[54] PROCESS FOR SEPARATING GLUCOSE AND MANNOSE WITH DEALUMINATED Y ZEOLITES

[75] Inventor: Santi Kulprathipanja, Inverness, Ill.

[73] Assignee: UOP, Des Plaines, Ill.

[21] Appl. No.: 395,009

[22] Filed: Aug. 17, 1989

[51] Int. Cl.[5] ..... C13D 3/12; C13D 3/14

[52] U.S. Cl. ..... 127/55; 127/46.3; 127/46.2; 210/660; 210/663; 210/690

[58] Field of Search ..... 127/46.2, 46.3, 55; 210/660, 663, 690

[56] References Cited

U.S. PATENT DOCUMENTS

| | | | |
|---|---|---|---|
| 2,985,589 | 5/1961 | Broughton et al. | 210/34 |
| 3,040,777 | 6/1962 | Carson et al. | 137/625.15 |
| 3,293,192 | 12/1966 | Maher et al. | 252/430 |
| 3,422,848 | 1/1969 | Liebman et al. | 137/625.15 |
| 3,706,812 | 12/1972 | De Rosset et al. | 620/674 |
| 4,262,032 | 4/1981 | Levin | 426/658 |
| 4,394,178 | 7/1983 | Chao et al. | 127/46.3 |
| 4,402,832 | 9/1983 | Gerhold | 210/659 |
| 4,440,855 | 4/1984 | Horwath et al. | 435/105 |
| 4,471,114 | 9/1984 | Sherman et al. | 536/127 |
| 4,478,721 | 10/1984 | Gerhold | 210/659 |
| 4,516,566 | 5/1985 | Chao et al. | 127/46.3 |
| 4,581,447 | 4/1986 | Arena | 536/125 |
| 4,707,190 | 11/1987 | Goodman | 127/46.2 |

FOREIGN PATENT DOCUMENTS 149463 7/1973 Czechoslovakia .

1540556 8/1979 United Kingdom .

OTHER PUBLICATIONS

J. Am. Chem. Soc., 68, 791,793 (1946), M. L. Wolfrom & A. Thompson Ber. Deutsch. Chem. Ges., 23, 370,389 (1890), E. Fischer.

Nature, 221,555 (1969), Cf. R. S. Shallenberger.

"The Theory of Sweetness," In Sweeteners and Sweetness, pp. 42–50, Edited by G. G. Birch & Coworkers.

R. S. Shallenberger & T. E. Acree in "The Handbook of Sensory Physiology," vol. 4, pp. 241–245 Edited by L. M. Beider (Springer Verlag, 1971).

J.A.C.S. vol. 69 (1947), pp. 1963–1965, Organic Chemistry, Morrison & Boyd (3d Ed. 1973) pp. 1078–1079 (Kiliani–Fischer Synthesis.

Julius Scherzer, The Preparation And Characterization of Aluminum–Deficient Zeolites, Catalytic Materials, J.A.C.S., 1984,pp. 157–200.

Chemtech, Aug. 1979 pp. 501,511.

*Primary Examiner*—Chung K. Pak

*Attorney, Agent, or Firm*—Thomas K. McBride; John F. Spears, Jr.; Jack H. Hall

[57] ABSTRACT

Glucose is separated from mixtures with mannose and other saccharides by adsorption on low aluminum Y-type zeolites, i.e., having up to about 50 atoms of aluminum per unit cell and desorbing the adsorbate with water. Glucose is removed from the adsorption process in the raffinate.

5 Claims, 8 Drawing Sheets

PROCESS FOR SEPARATING GLUCOSE AND MANNOSE WITH DEALUMINATED Y ZEOLITES

BACKGROUND OF THE INVENTION

1. Field of the Invention

This invention relates to the separation of L-glucose and L-mannose from mixtures of the two and other sugar mixtures. Also, this invention relates to the separation by selective adsorption of L-glucose and L-mannose with certain crystalline aluminosilicate zeolitic molecular sieves.

2. Background of the Invention

Artificial sweeteners recently have seen increased use as a replacement for the "natural" sugars, including sucrose and fructose. Such artificial sweeteners have been under continual review for possible adverse long term physiological affects, yet their demand has grown unabated. Accompanying their growth as a commercial area with substantial economic impact has been a renewed emphasis on discovering and supplying new artificial sweeteners, particularly in pure form rather than as mixtures of different products.

The ideal artificial sweetener would be noncaloric, noncariogenic; without detrimental physiological effects, and usable by diabetics. All these requirements would be met if a sweetener were not metabolized by humans and by flora which are found in the mouth and intestinal tract, and if the sweetener were either not absorbed by humans, or absorbed without effect on any internal organ. That is, the ideal sweetener should be excreted in the same form as when ingested. Another desirable feature is that it have bulk properties and texture similar to sucrose so that it can be substituted for table sugar in many formulations. Recently, and perhaps belatedly, attention has turned toward the L-sugars as desirable artificial sweeteners. It has been known since at least 1946 that L-fructose is sweet (M. L. Wolfrom and A. Thompson, *J. Am. Chem. Soc.*, 68, 791,793 (1946)), and since at least 1890 that L-fructose is nonfermentable (E. Fischer, *Ber. Deutsch. Chem. Ges.*, 23 370,389 (1890)), hence not metabolized by microorganisms generally metabolizing D-sugars. A reasonable, although not necessarily correct, inference is that it also is not metabolized by humans. Assuming that L-glucose is a sweet nonmetabolite (Chemtech, Aug. 1979, pp 501,511), it becomes desirable to isolate it from the reaction mixture in which it is normally found and use it as a noncaloric sweetener in many formulations. L-glucose is quite often found in admixture with L-mannose and often with L-mannose in preponderance. More recently Shallenberger and coworkers have demonstrated that many L-sugars have a sweetness comparable to their L-enantiomorphs. *Nature*, 221, 555 (1969). Cf. R. S. Shallenberger, "The Theory of Sweetness," in Sweeteners and Sweetness, pp 42–50, Edited by G. G. Birch and coworkers; R. S. Shallenberger and T. E. Acree in "The Handbook of Sensory Physiology," Vol. 4, pp 241–5, Edited by L. M. Beider (Springer Verlag, 1971).

Exploitation of the favorable properties of L-sugars is hindered by their relative unavailability. L-glucose for example, is not found to any significant extent in nature. This unavailability has spurred recent efforts in developing commercially feasible methods for preparing L-sugars in amounts necessary for their use as a staple of commerce. Although the preparation of a number of L-sugars is described in U.S. Pat. No. 4,262,032 the focus seems to be on typical laboratory methods wholly unsuited for economical industrial production, in contrast to the process herein.

Glucose can be prepared in several other ways, but usually the product is mixed with mannose. According to Bilik (Czech. Patent No. 149,463 dated July 15, 1973) L-mannose may be epimerized catalytically to L-glucose and L-mannose in 3:1 ratio. Then, L-glucose can be separated by crystallization and the syrup recycled. L-mannose is also produced, along with L-glucose, from L-arabinose by cyanide addition and hydrogenation, according to Arena et al. U.S. Pat. No. 4,581,447. Using L-arabinose at 95% purity or greater, a mixture of L-glucose and L-mannose is produced in almost a 2:1 ratio with about 1% arabinose as an impurity. L-arabinose is one of the few L-sugars available freely in nature, such as from sugar beet pulp and rice hulls. According to U.S. Pat. No. 4,516,566, L-arabinose may be obtained from different sources of cellulose, e.g., beet pulp, wood, along with other saccharides in the product mixtures depending upon the source of cellulose (U.S. Pat. No. 4,516,566 at column I, lines 53–58). Further, U.S. Pat. No. 4,440,855 discloses two other methods for deriving L-glucose and L-mannose from L-arabinose: The Sowden-Fischer conversion (J.A.C.S. Vol. 69 (1947) pp 1963–65) and the Kiliani-Fischer synthesis (*Organic Chemistry*, Morrison and Boyd (3rd. Ed. 1973) pp 1078–9).

It is known from Sherman et al. U.S. Pat. No. 4,471,114 that mannose and glucose can be separated from a solution of the same by selective adsorption on only certain cation-exchanged type X or type Y zeolitic molecular sieves. Specifically, Ba-exchanged X- or Y-type and Sr-, Na- and Ca-exchanged Y-type zeolites will selectively adsorb mannose thereon. In other words, the separation by this particular zeolite is ion-specific. The nonadsorbed portion is removed from contact with the zeolite. The mannose can be desorbed from the zeolite with a desorbent and recovered.

It is also known from British Patent No. 1,540,556 to separate mannose from glucose with a cationic exchange resin, such as Amberlite XE 200. It has been reported, however, that a two-stage separation, using the identical column in each stage, is required to produce a 98% mannose product. Such a process is inefficient and prohibitively expensive.

The separation of certain specific carbohydrates with dealuminated Y zeolites is also known e.g., Chao et al U.S. Pat. No. 4,394,178, but there is no disclosure therein of my novel process for separating glucose from mannose and, further, the separation disclosed in Chao et al is also ion-specific in that only a very limited number of exchange ions are effective.

SUMMARY OF THE INVENTION

It is accordingly an object of the invention to provide a process for separating L-glucose from L-mannose in order to obtain an economical way to obtain the non-nutritive sugar, L-glucose, in good yield. The industry desires these or other substitute sweeteners to satisfy the ultimate food and confections customers craving for a non-fattening sweetener with little or no physiological side effects. Another object of the invention is to provide a process for separating L-glucose from a mixture containing L-fructose and L-mannose by an adsorption process using a dealuminated Y faujasite zeolite molecular sieve. More specifically, the faujasite used has a low aluminum content, i.e., up to about 50 aluminum atoms per unit cell (Al/U.C.) and preferably, from about 5 to about 10 Al/U.C. The faujasites are useful because they have a pore size large enough to admit the sugar molecules being adsorbed whereas silicalite and ZSM-5 have pore sizes too small to admit the saccharide molecules. The faujasites may be exchanged to the extent that the low-aluminum zeolites are exchangeable, by most ions, without any effect on the adsorptive factors or capacity, but the separation is not ion-specific, that is, there is no requirement for specific ions to be in the exchangeable ion sites. Thus, this separation has significant advantage over ion-specific zeolites in the separation, since the substitution required ions by others during the separation process does not reduce the activity of the zeolite which would require regeneration of the spent zeolite.

As hereinbefore set forth, the present invention is concerned with a process for separating L-glucose from an aqueous mixture containing L-glucose and L-mannose. The process is effected by passing a feed mixture containing one or more components over an adsorbent of the type hereinafter set forth in greater detail. The passage of the feed stream over the adsorbent will result in the adsorption of mannose while permitting glucose and the other components of the feed stream to pass through the treatment zone in an unchanged condition. Thereafter the mannose will be desorbed from the adsorbent by treating the adsorbent with a desorbent material, preferably water. Adsorption and desorption conditions include a temperature in the range of from about 20° to about 200° C. and a pressure in the range of from about atmospheric to about 500 psig to ensure a liquid phase. The preferred conditions are 65° C. and about 50 psig.

BRIEF DESCRIPTION OF THE DRAWINGS

Each FIGS., 1–7 is a chromatographic trace showing separation of L-glucose from L-mannose, by an adsorbent, comprising a dealuminated Y faujasite having up to 50 Al/U.C. and having exchangeable ionic sites exchanged by $H^+$, $Ca^{++}$, $NH_4^+$ or $Sr^{++}$.

DETAILED DESCRIPTION OF THE INVENTION

Figure 1:
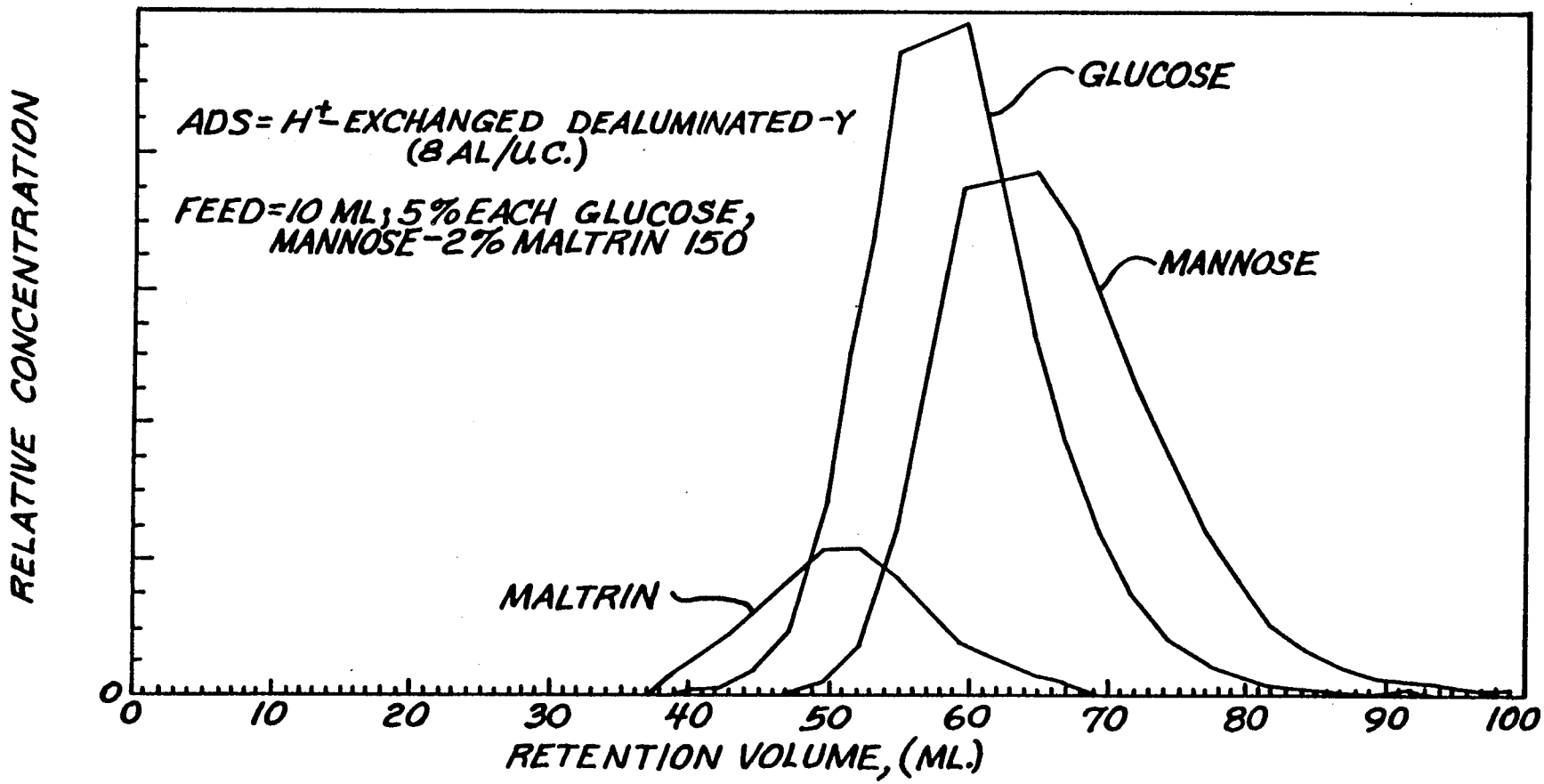

For purposes of this invention, the various terms which are hereinafter used may be defined in the following manner.

A "feed mixture" is a mixture containing one or more extract components and one or more raffinate components to be separated by the process. The term "feed stream" indicates a stream of a feed mixture which passes to the adsorbent used in the process.

An "extract component" is a compound or type of compound that is more selectively adsorbed by the adsorbent while a "raffinate component" is a compound or type of compound that is less selectively adsorbed. The term "desorbent material" shall means generally a material capable of desorbing an extract component. The term "desorbent stream" or "desorbent input stream" indicates the stream through which desorbent material passes to the adsorbent. The term "raffinate stream" or "raffinate output stream" means a stream through which a raffinate component is removed from the adsorbent. The composition of the raffinate stream can vary from essentially 100% desorbent material to essentially 100% raffinate components. The term "extract stream" or "extract output stream" shall mean a stream through which an extract material which has been desorbed by a desorbent material is removed from the adsorbent. The composition of the extract stream, likewise, can vary from essentially 100% desorbent material to essentially 100% extract components. At least a portion of the extract stream and preferably, at least a portion of the raffinate stream from the separation process are passed to separation means, typically fractionators, where at least a portion of desorbent material is separated to produce an extract product and a raffinate product. The terms "extract product" and "raffinate product" mean products produced by the process containing, respectively, an extract component and a raffinate component in higher concentrations than those found in the extract stream and the raffinate stream.

The feed mixtures which are charged to the process of the present invention will comprise sugar sources, a specific source which is utilized in the present invention comprising mannose epimerization products. As I have found, mannose epimerization products can contain about 65% glucose and 35% mannose.

The adsorbents of the present invention have been found to adsorb mannose selectively over glucose. In addition, it has also been found that the initial performance of the adsorbent is maintained during the actual use in the separation process over an economically desirable life. In addition, as previously set forth, the adsorbent of this invention possesses the ability to separate components of the feed, that is, that the adsorbent possesses adsorptive selectively for one component as compared to other components. The adsorbents used in the separation of this invention are the so-called dealuminated Y-type zeolites such as those obtained from Toyo Soda having, e.g., 5–20 aluminum atoms per unit cell (Al/U.C.). It has been determined that zeolites of this type having 0–50 aluminum atoms per unit cell will effect the desired separation between mannose and glucose. The zeolites may be made by one or more of the processes described in Julius Scherzer, The Preparation and Characterization of Aluminum-Deficient Zeolites, Catalytic Materials, *J.A.C.S.*, 1984. pp 157–200, but preferably by the thermal dealumination process described on pages 158–161 involving the hydrothermal treatment of $NH_4$-Y zeolite, or U.S. Pat. No. 3,293,192 to Maher et al., to form the class of dealuminated Y zeolites referred to as "ultrastable."

As with other Y zeolites, the dealuminated Y zeolites may have exchange sites exchanged with other ions for the sodium ions the zeolite is initially prepared with, but the low aluminum content limits the amount of exchange which can take place. Exchange methods are well known to those of ordinary skill in the art and are suitable for the zeolites of this invention. My invention is not dependent, as are other carbohydrate separation processes using Y zeolites, for example, the aforementioned U.S. Pat. Nos. 4,471,114 or 4,394,178, on the presence of specific exchange ions in the zeolite. In addition to strontium-, calcium-, sodium-, or barium-exchanged dealuminated Y zeolites, other ions, previously thought unsuitable for the separation, are found to be quite suitable for my separation process, for example, potassium, cesium, ammonium and magnesium.

Typically, adsorbents used in separative processes contain zeolite crystals dispersed in an amorphous material or inorganic matrix. The zeolite will typically be present in the adsorbent in amounts ranging from about 75 to about 98 wt. % based on volatile-free composition. Volatile-free compositions are generally determined after the adsorbent has been calcined at 900° C. in order to drive off all volatile matter. The remainder of the adsorbent will generally be the inorganic matrix material such as silica, titania, or alumina or mixtures thereof, or compounds, such as clays, which material is present in intimate mixture with the small particles of the zeolite material. This matrix material may be an adjunct of the manufacturing process for zeolite (for example, intentionally incomplete purification of either zeolite during its manufacture) or it may be added to relatively pure zeolite, but in either case its usual purpose is as a binder to aid in forming or agglomerating the hard crystalline particles, such as extrudates, aggregates, tablets, macrospheres or granules having a desired particle size range. The typical adsorbent will have a particle size range of about 16–60 mesh (Standard U.S. Mesh).

The number of aluminum atoms per unit cell of each sample used was determined by X-ray diffractometry measurement of the cell dimension and compared with previously recorded cell dimensions correlated with aluminum content.

Relative selectivity can be expressed not only for one feed compound as compared to another but can also be expressed between any feed mixture component and the desorbent material. The selectivity, ($\beta$), as used throughout this specification is defined as the ratio of the two components in the adsorbed phase over the ratio of the same two components in the unadsorbed phase at equilibrium conditions. Relative selectivity is shown as Equation 1, below.

$$\text{Selectivity } (\beta) = \frac{\text{wt. percent } C/\text{wt. percent } D_A}{\text{wt. percent } C/\text{wt. percent } D_U} \qquad \text{Equation 1}$$

where C and D are two components of the feed represented in weight percent and the subscripts A and U represent the absorbed and unasorbed phases, respectively. The equilibrium conditions are determined when the feed passing over a bed of adsorbent does not change composition, in other words, when there is no net transfer of material occurring between the unadsorbed and adsorbed phases. Where selectivity of two components approaches 1.0, there is no preferential adsorption of one component by the adsorbent with respect to the other; they are both adsorbed (or nonadsorbed) to about the same degree with respect to each other. As the ($\beta$) becomes less than or greater than 1.0, there is a preferential adsorption by the adsorbent for one component with respect to the other. When comparing the selectivity by the adsorbent of one component C over component D, a ($\beta$) larger than 1.0 indicates preferential adsorption of component C within the adsorbent. A ($\beta$) less than 1.0 would indicate that component D is preferentially adsorbed leaving an unadsorbed phase richer in component C and an adsorbed phase richer in component D.

While separation of an extract component from a raffinate component is theoretically possible when the selectivity of the adsorbent for the extract component with respect to the raffinate component is greater than 1, it is preferred that such selectivity approach a value of 2. Like relative volatility, the higher the selectivity, the easier the separation is to perform. Higher selectivities permit a smaller amount of adsorbent to be used.

An important characteristic of the adsorbent is the rate of exchange of the extract component of the feed mixture material or, in other words, the relative rate of desorption of the extract component. This characteristic relates directly to the amount of desorbent material that must be employed in the process to recover the extract component from the adsorbent; faster rates of exchange reduce the amount of desorbent material needed to remove the extract component, and therefore, permit a reduction in the operating cost of the process. With faster rates of exchange, less desorbent material has to be pumped through the process and separated from the extract stream for reuse in the process. Ideally, desorbent materials should have a selectivity equal to about 1 or slightly less than 1 with respect to all extract components so that all of the extract components can be desorbed as a class with reasonable flow rates of desorbent material, and so that extract components can displace desorbent material in a subsequent adsorption step.

Resolution is a measure of the degree of separation of a two-component system, and can assist in quantifying the effectiveness of a particular combination of adsorbent, desorbent, conditions, etc. for a particular separation. Resolution for purposes of this application is defined as the distance between the two peak centers divided by the average width of the peaks at ½ the peak height as determined by the pulse tests described hereinafter. The equation for calculating resolution is thus:

$$R = \frac{L_2 - L_1}{\frac{1}{2}(W_1 + W_2)}$$

where $L_1$ and $L_2$ are the distance, in ml, respectively, from a reference point, e.g., zero to the centers of the peaks and $W_1$ and $W_2$ are the widths of the peaks at ½ the height of the peaks.

Desorbent materials used in various prior art adsorptive separation processes vary depending upon such factors as the type of operation employed. In the swing-bed system, in which the selectively adsorbed feed component is removed from the adsorbent by a purge stream, desorbent selection is not as critical and desorbent material comprising gaseous hydrocarbons such as methane, ethane, etc., or other types of gases such as nitrogen or hydrogen, may be used at elevated temperatures or reduced pressures or both to effectively purge the adsorbed feed component from the adsorbent. However, in adsorptive separation processes, which are generally operated continuously at substantially constant pressures and temperatures to insure liquid phase, the desorbent material must be judiciously selected to satisfy many criteria. First, the desorbent material should displace an extract component from the adsorbent with reasonable mass flow rates without itself being so strongly adsorbed as to unduly prevent an extract component from displacing the desorbent material in a following adsorption cycle. Expressed in terms of the selectivity (hereinbefore discussed in more detail), it is preferred that the adsorbent be more selective for all of the extract components with respect to a raffinate component than it is for the desorbent material with respect to a raffinate component. Secondly, desorbent materials must be compatible with the particular adsorbent and the particular feed mixture. More specifically, they must not reduce or destroy the critical selectivity of the adsorbent for an extract component with respect to a raffinate component. Additionally, desorbent materials should not chemically react with or cause a chemical reaction of either an extract component or a raffinate component. Both the extract stream and the raffinate stream are typically removed from the adsorbent in admixture with desorbent material and any chemical reaction involving a desorbent material and an extract component or a raffinate component or both would complicate or prevent product recovery. Since both the raffinate stream and the extract stream typically contain desorbent materials, desorbent materials should additionally be substances which are easily separable from the feed mixture that is passed into the process. Without a method of separating at least a portion of the desorbent material present in the extract stream and the raffinate stream, the concentration of an extract component in the extract product and the concentration of a raffinate component in the raffinate product would not be very high, nor would the desorbent material be available for reuse in the process. It is contemplated that at least a portion of the desorbent material will be separated from the extract and the raffinate streams by distillation or evaporation, but other separation methods such as reverse osmosis may also be employed alone or in combination with distillation or evaporation. Since the raffinate and extract products herein are foodstuffs intended for human consumption, desorbent materials should also be nontoxic. Finally, desorbent materials should also be materials which are readily available and, therefore, reasonable in cost.

A dynamic testing apparatus is employed to test various adsorbents with a particular feed mixture and desorbent material to measure the adsorbent characteristics of adsorptive capacity, selectivity, resolution and exchange rate. The apparatus consists of an adsorbent chamber of approximately 70 cc volume having inlet and outlet portions at opposite ends of the chamber. The chamber is contained within a temperature control means and, in addition, pressure control equipment is used to operate the chamber at a constant predetermined pressure. Quantitative and qualitative analytical equipment such as refractometers, polarimeters and chromatographs can be attached to the outlet line of the chamber and used to detect quantitatively or determine qualitatively one or more components in the effluent stream leaving the adsorbent chamber. A pulse test, performed using this apparatus and the following general procedure, is used to determine selectivities, resolution and other data for various adsorbent systems. The adsorbent is filled to equilibrium with a particular desorbent material by passing the desorbent material through the adsorbent chamber. The preferred desorbent is water, but ethanol, methanol or acetone can also be used. The feed mixture, containing glucose and mannose, diluted in desorbent is injected for a duration of several minutes. Desorbent flow is resumed, and the glucose and mannose are eluted as in a liquid-solid chromatographic operation. The effluent can be analyzed on-stream or, alternatively, effluent samples can be collected periodically and later analyzed separately by analytical equipment and traces of the envelopes of corresponding component peaks developed.

From information derived from the test, adsorbent performance can be rated in terms of void volume, retention volume for an extract or a raffinate component, selectivity for one component with respect to the other, the resolution between the components and the rate of desorption of an extract component by the desorbent. The retention volume of an extract or a raffinate component may be characterized by the distance between the center of the peak envelope of an extract or a raffinate component and the peak envelope of a tracer component or some other known reference point. It is expressed in terms of the volume in cubic centimeters of desorbent pumped during this time interval represented by the distance between the peak envelopes. Selectivity, ($\beta$), for an extract component with respect to a raffinate component may be characterized by the ratio of the distance between the center of the extract component peak envelope and the tracer peak envelope (or other reference point) to the corresponding distance between the center of the raffinate component peak envelope and the tracer peak envelope. The rate of exchange of an extract component with the desorbent can generally be characterized by the width of the peak envelopes at half intensity. The narrower the peak width, the faster the desorption rate. The desorption rate can also be characterized by the distance between the center of the tracer peak envelope and the disappearance of an extract component which has just been desorbed. This distance is again the volume of desorbent pumped during this time interval.

The adsorbent may be employed in the form of a dense compact fixed bed which is alternately contacted with the feed mixture and desorbent materials. In the simplest embodiment of the invention, the adsorbent is employed in the form of a single static bed in which case the process is only semicontinuous. In another embodiment, a set of two or more static beds may be employed in fixed-bed contact with appropriate valving so that the feed mixture is passed through one or more adsorbent beds while the desorbent materials can be passed through one or more of the other beds in the set. The flow of feed mixture and desorbent materials may be either up or down through the desorbent. Any of the conventional apparatus employed in static bed fluid-solid contacting may be used.

Countercurrent moving bed or simulated moving bed countercurrent flow systems, however, have a much greater separation efficiency than fixed adsorbent bed systems and are, therefore, preferred. In the moving bed or simulated moving bed processes, the adsorption and desorption operations are continuously taking place which allows both continuous production of an extract and a raffinate stream and the continual use of feed and desorbent streams. One preferred embodiment of this process utilizes what is known in the art as the simulated moving bed countercurrent flow system. The operating principles and sequence of such a flow system are described in U.S. Pat. No. 2,985,589, incorporated by reference herein. In such a system, it is the progressive movement of multiple liquid access points down an adsorbent chamber that simulates the upward movement of adsorbent contained in the chamber. Only four of the access lines are active at any one time: the feed input stream, desorbent inlet stream, raffinate outlet stream, and extract outlet stream access lines. Coincident with this simulated upward movement of the solid adsorbent is the movement of the liquid occupying the void volume of the packed bed of adsorbent. So that countercurrent contact is maintained, a liquid flow down the adsorbent chamber may be provided by a pump. As an active liquid access point moves through a cycle, that is, from the top of the chamber to the bottom, the chamber circulation pump moves through different zones which require different flow rates. A programmed flow controller may be provided to set and regulate these flow rates.

The active liquid access points effectively divide the adsorbent chamber into separate zones, each of which has a different function. In this embodiment of the present process, it is generally necessary that three separate operational zones be present in order for the process to take place, although, in some instances, an optional fourth zone may be used.

The adsorption zone, zone 1, is defined as the adsorbent located between the feed inlet stream and the raffinate outlet stream. In this zone, the feedstock contacts the adsorbent, an extract component is adsorbed, and a raffinate stream is withdrawn. Since the general flow through zone 1 is from the feed stream which passes into the zone to the raffinate stream which passes out of the zone, the flow in this zone is considered to be a downstream direction when proceeding from the feed inlet to the raffinate outlet streams.

Immediately upstream, with respect to fluid flow in zone 1, is the purification zone, zone 2. The purification zone is defined as the adsorbent between the extract outlet stream and the feed inlet stream. The basic operations taking place in zone 2 are the displacement from the nonselective void volume of the adsorbent of any raffinate material carried into zone 2 by shifting of adsorbent into this zone and the desorption of any raffinate material adsorbed within the selective pore volume of the adsorbent or adsorbed on the surfaces of the adsorbent particles. Purification is achieved by passing a portion of extract stream material leaving zone 3 into zone 2 at zone 2's upstream boundary, the extract outlet stream, to effect the displacement of raffinate material. The flow of material in zone 2 is in a downstream direction from the extract outlet stream to the feed inlet stream.

Immediately upstream of zone 2 with respect to the fluid flowing in zone 2 is the desorption zone or zone 3. The desorption zone is defined as the adsorbent between the desorbent inlet and the extract outlet streams. The function of the desorbent zone is to allow a desorbent material which passes into this zone to displace the extract component which was adsorbed upon the adsorbent during a previous contact with feed in zone 1 in a prior cycle of operation. The flow of fluid in zone 3 is essentially in the same direction as that of zones 1 and 2.

In some instances, an optional buffer zone, zone 4, may be utilized. This zone, defined as the adsorbent between the raffinate outlet stream and the desorbent inlet stream, if used, is located immediately upstream with respect to the fluid flow to zone 3. Zone 4 would be utilized to conserve the amount of desorbent utilized in the desorption step since a portion of the raffinate stream which is removed from zone 1 can be passed into zone 4 to displace desorbent material present in that zone out of that zone into the desorption zone. Zone 4 will contain enough adsorbent so that raffinate material present in the raffinate stream passing out of zone 1 and into zone 4 can be prevented from passing into zone 3 thereby contaminating extract stream removed from zone 3. In the instances in which the fourth operational zone is not utilized, the raffinate stream passed from zone 1 to zone 4 must be carefully monitored in order that the flow directly from zone 1 to zone 3 can be stopped when there is an appreciable quantity of raffinate material present in the raffinate stream passing from zone 1 into zone 3 so that the extract outlet stream is not contaminated.

A cyclic advancement of the input and output streams through the fixed bed of adsorbent can be accomplished by utilizing a manifold system in which the valves in the manifold are operated in a sequential manner to effect the shifting of the input and output streams thereby allowing a flow of fluid with respect to solid adsorbent in a countercurrent manner. Another mode of operation which can effect the countercurrent flow of solid adsorbent with respect to fluid involves the use of a rotating disc valve in which the input and output streams are connected to the valve and the lines through which feed input, extract output, desorbent input and raffinate output streams are advanced in the same direction through the adsorbent bed. Both the manifold arrangement and disc valve are known in the art. Specifically, rotary disc valves which can be utilized in this operation can be found in U.S. Pat. Nos. 3,040,777 and 3,422,848. Both of the aforementioned patents disclose a rotary type connection valve in which the suitable advancement of the various input and output streams from fixed sources can be achieved without difficulty.

In many instances, one operational zone will contain a much larger quantity of adsorbent than some other operational zone. For instance, in some operations the buffer zone can contain a minor amount of adsorbent as compared to the adsorbent required for the adsorption and purification zones. It can also be seen that in instances in which desorbent is used which can easily desorb extract material from the adsorbent that a relatively small amount of adsorbent will be needed in a desorption zone as compared to the adsorbent needed in the buffer zone or adsorption zone or purification zone or all of them. Since it is not required that the adsorbent be located in a single column, the use of multiple chambers or a series of columns is within the scope of the invention.

It is not necessary that all of the input or output streams be simultaneously used, and in fact, in many instances some of the streams can be shut off while others effect an input or output of material. The apparatus which can be utilized to effect the process of this invention can also contain a series of individual beds connected by connecting conduits upon which are placed input or output taps to which the various input or output streams can be attached and alternately and periodically shifted to effect continuous operation. In some instances, the connecting conduits can be connected to transfer taps which during the normal operations do not function as a conduit through which material passes into or out of the process.

It is contemplated that at least a portion of the extract output stream will pass into a separation means wherein at least a portion of the desorbent material can be separated to produce an extract product containing a reduced concentration of desorbent material. Preferably, but not necessary to the operation of the process, at least a portion of the raffinate output stream will also be passed to a separation means wherein at least a portion of the desorbent material can be separated to produce a desorbent stream which can be reused in the process and a raffinate product containing a reduced concentration of desorbent material. Separation will typically be by crystallization. The design and operation of crystallization apparatus are well known to the separation art.

Although both liquid and vapor phase operations can be used in many adsorptive separation processes, liquid-phase operation is preferred for this process because of the lower temperature requirements and because of the higher yields of extract product that can be obtained with liquid-phase operation over those obtained with vapor-phase operation. Adsorption conditions will include a temperature range of from about 20° to about 200° C., with 20° to about 100° C. being more preferred and a pressure range of from about atmospheric to about 500 psig with from about atmospheric to about 250 psig being more preferred to insure liquid phase. Desorption conditions will include the same range of temperatures and pressures as used for adsorption conditions.

The size of the units which can utilize the process of this invention can vary anywhere from those of pilot plant scale (see for example my assignee's U.S. Pat. No. 3,706,812) to those of commerical scale and can range in flow rates from as little as a few cc's an hour up to many thousands of gallons per hour.

Another embodiment of a simulated moving bed flow system suitable for use in the process of the present invention is the cocurrent high efficiency simulated moving bed process disclosed in U.S. Pat. Nos. 4,402,832 and 4,478,721 to Gerhold, incorporated by reference herein in its entirety. This process may be preferred, because of its energy efficiency and lower capital intensity, where products of slightly lower purity are acceptable.

The examples shown below are intended to further illustrate the process of this invention and are not to be construed as unduly limiting the scope and spirit of said process. The examples present test results for various adsorbent and desorbent materials when using the previously described dynamic testing apparatus.

EXAMPLE I

In this example, a test was run using a dealuminated Y-type zeolite (US-Y #8, obtained from Toyo Soda) having 8 aluminum atoms per unit cell to determine the separation of glucose from a mixture representative of that expected from an epimerization product of L-mannose. The dealuminated Y-type zeolite of this example was bound in Bentonite clay and exchangeable sites were exchanged by $H^+$. The adsorbent had an average bulk density of 0.85 g/ml. The adsorbent was packed in an 8.4 mm diameter column having a total volume of 70 cc. The feed mixture consisted of 10 ml of the carbohydrate mixture (12% solids) given in Table 1.

TABLE 1

| | Wt. % |
|---|---|
| Mannose | 5 |
| Glucose | 5 |
| Maltrin 150 (DP3, DP4 + ) | 2 |
| Water | 88 |
| | 100 |

Maltrin 150 is a commercially available mixture containing 88% saccharides having a degree of polymerization of 4 or more (DP4+), 8.1% maltotriose, having a DP of 3, about 3% maltose and less than 2% glucose.

The experiment began by passing water desorbent through the column at a flow rate of 1.2 cc/min. and a temperature of 65° C. At a convenient time, 10 ml of feed was injected into the column after which flow of desorbent was immediately resumed. FIG. 1 provides a graphical representation of the adsorbent's retention of the sugars in the feed.

A consideration of the average midpoint for each concentration curve reveals separation of glucose from the mannose in the feed mixture. While a substantial portion of the mannose curve does lie within the glucose curve, there is adequate mannose/glucose selectivity as seen by the differences in retention volume (▲ R.V.) shown in Table 2. $\beta$ (selectivity) maltose/glucose is 1.86, calculated in the manner discussed heretofore. Excellent selectivity of the adsorbent for glucose compared to mannose was found shown by the large R.V. in Table 2.

TABLE 2

| | Width at Half Peak Height | Retention Vol. (R.V.) (ml) | Selectivity ($\beta$-M/G) |
|---|---|---|---|
| Maltrin 150 | 14.1 | — | |
| Glucose | 13.7 | 7.6 | |
| Mannose | 17.1 | 14.1 | 1.86 |

Resolution is adequate for the separation as shown by the following calculation:

$$R = \frac{RV2 - RV1}{\frac{1}{2}(W_1 + W_2)} = \frac{14.1 - 7.6}{\frac{1}{2}(13.7 + 17.1)} = \frac{6.5}{15} = 0.43$$

EXAMPLE II

To show the separation of glucose with a different exchange ion in the adsorbent, another test was run using the same dealuminated Y-type zeolite as used in Example I (US-Y #8) having 8 aluminum atoms per unit cell, but exchanged with $Ca^{++}$ ions in the same testing apparatus. The zeolite was bound with clay which had no effect on the separation. The same feed mixture was used as in Example I.

Figure 2:
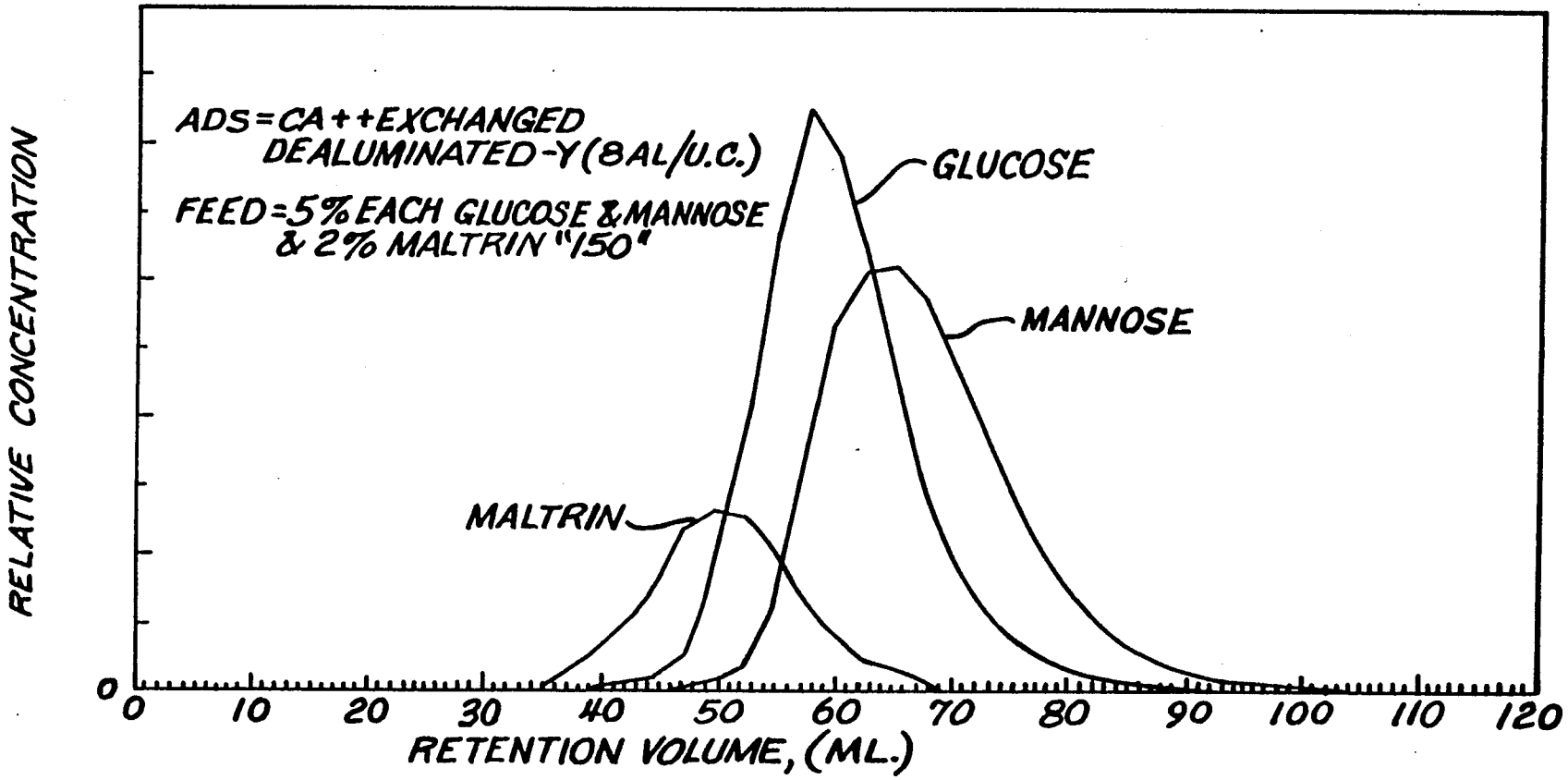

The pulse test was conducted in the same manner as Example I. FIG. 2 shows graphically the relative retention of the sugars by the adsorbent. Very little difference between Example II and Example I shows up. The selectivity of mannose/glucose was 1.78. Resolution was 0.45.

EXAMPLE III

Figure 3:
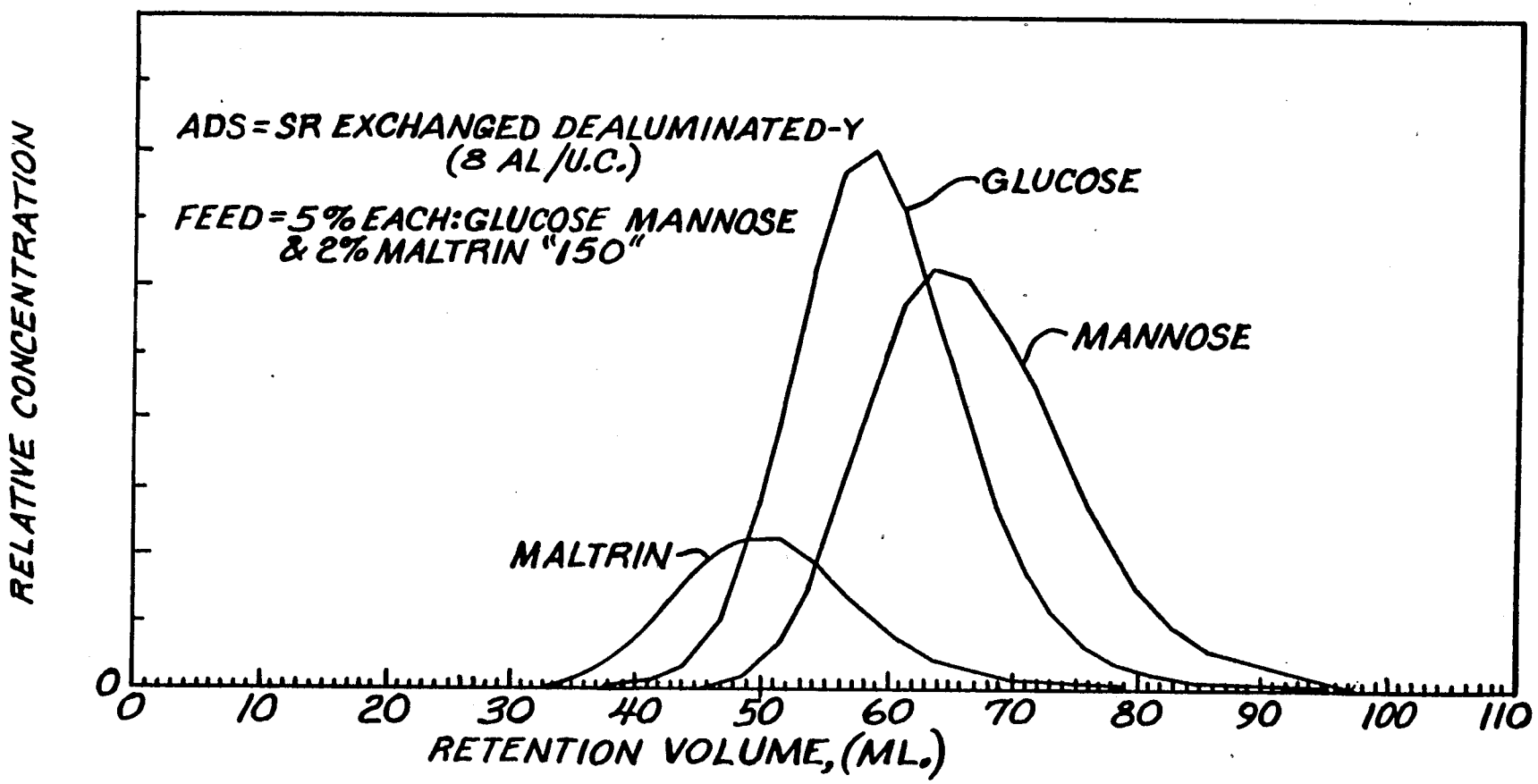

Another pulse test was conducted with the same feed mixture using the same dealuminated Y faujasite zeolite as in Example I (US-Y #8) having 8 aluminum atoms per unit cell, but was ion-exchanged with strontium. FIG. 3 shows the separation of mannose from glucose. $\beta$-M/G is 1.8 and resolution is 0.4. Again, the results are almost identical to those in Examples I and II, indicating that the ion exchange makes practically no difference in the separation process. This is furthermore advantageous, because there is thus no need for replacing ions lost or reexchanged during a separation. Normally, when ion-exchanged zeolites are used for separations, any ions removed or exchanged during the separation must be replaced, since a particular separation (or at least optimum conditions) takes place only with the given ion.

EXAMPLE IV

Figure 4:
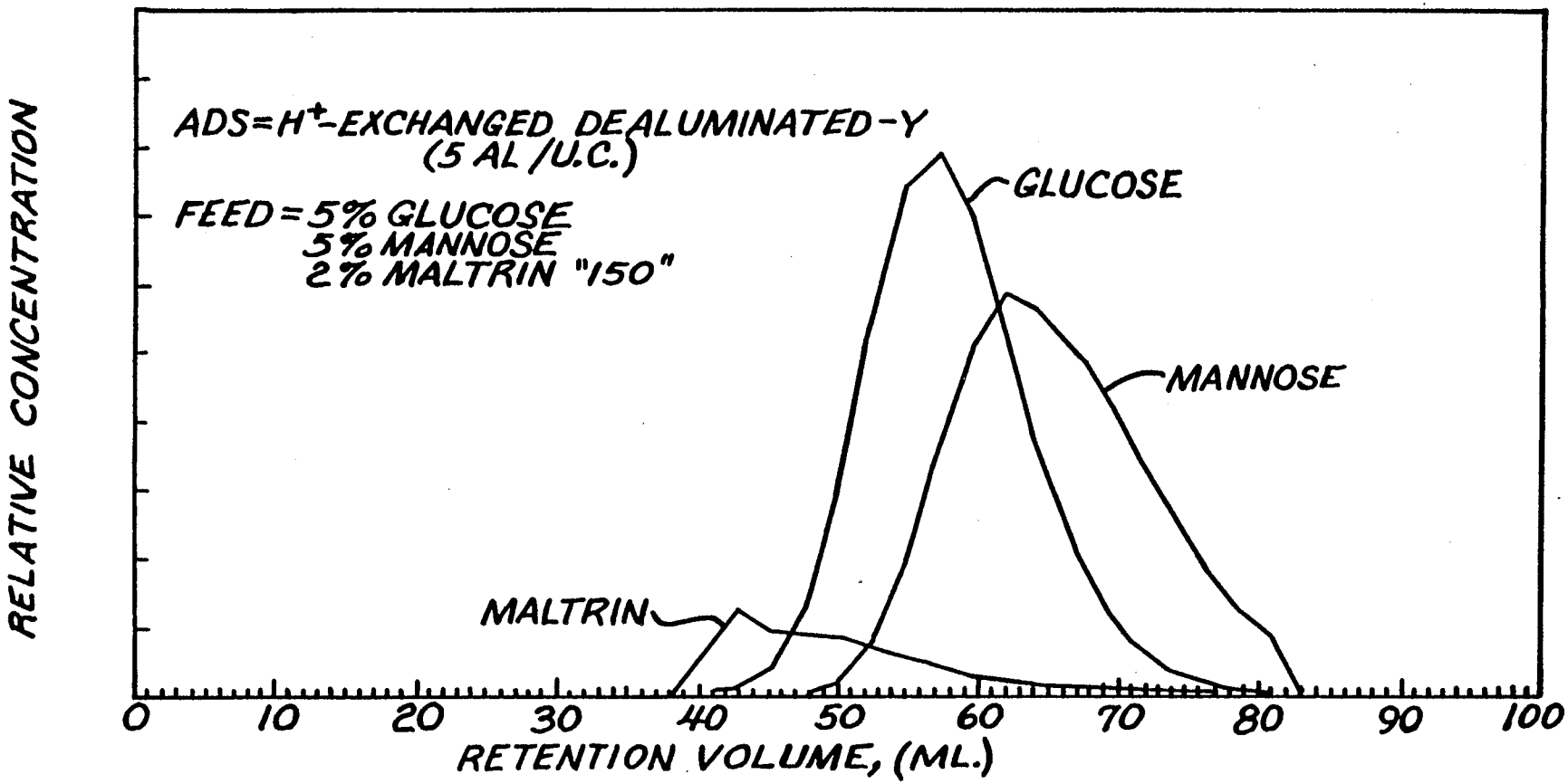

Example I was repeated except that the faujasite (Toyo Soda (US-Y #9)) had 5 aluminum atoms per unit cell and was $H^+$ exchanged. The separation of mannose from glucose is shown in FIG. 4. The glucose is well separated from the mannose; β-G/M is 1.73. Resolution was 0.49.

EXAMPLE V

Figure 5:
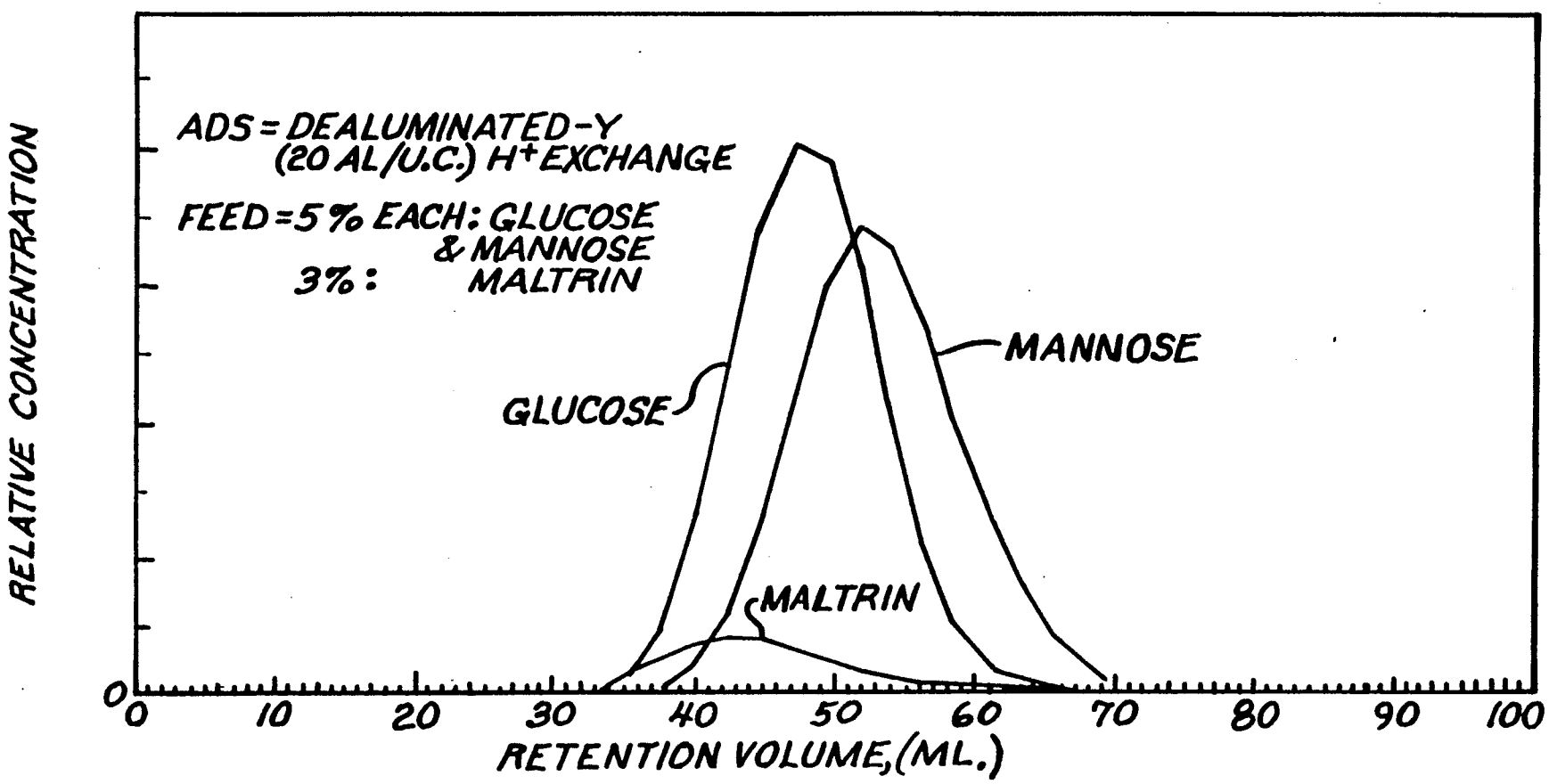

Example I was repeated except that the faujasite (Toyo Soda US-Y #6) had 20 aluminum atoms per unit cell and was $H^+$ exchanged. The separation of glucose and mannose was carried out with quite satisfactory results, β-M/G=2.3. Resolution between mannose and glucose was 0.38. The pulse test chromatogram is shown in FIG. 5.

EXAMPLE VI

Figure 6:
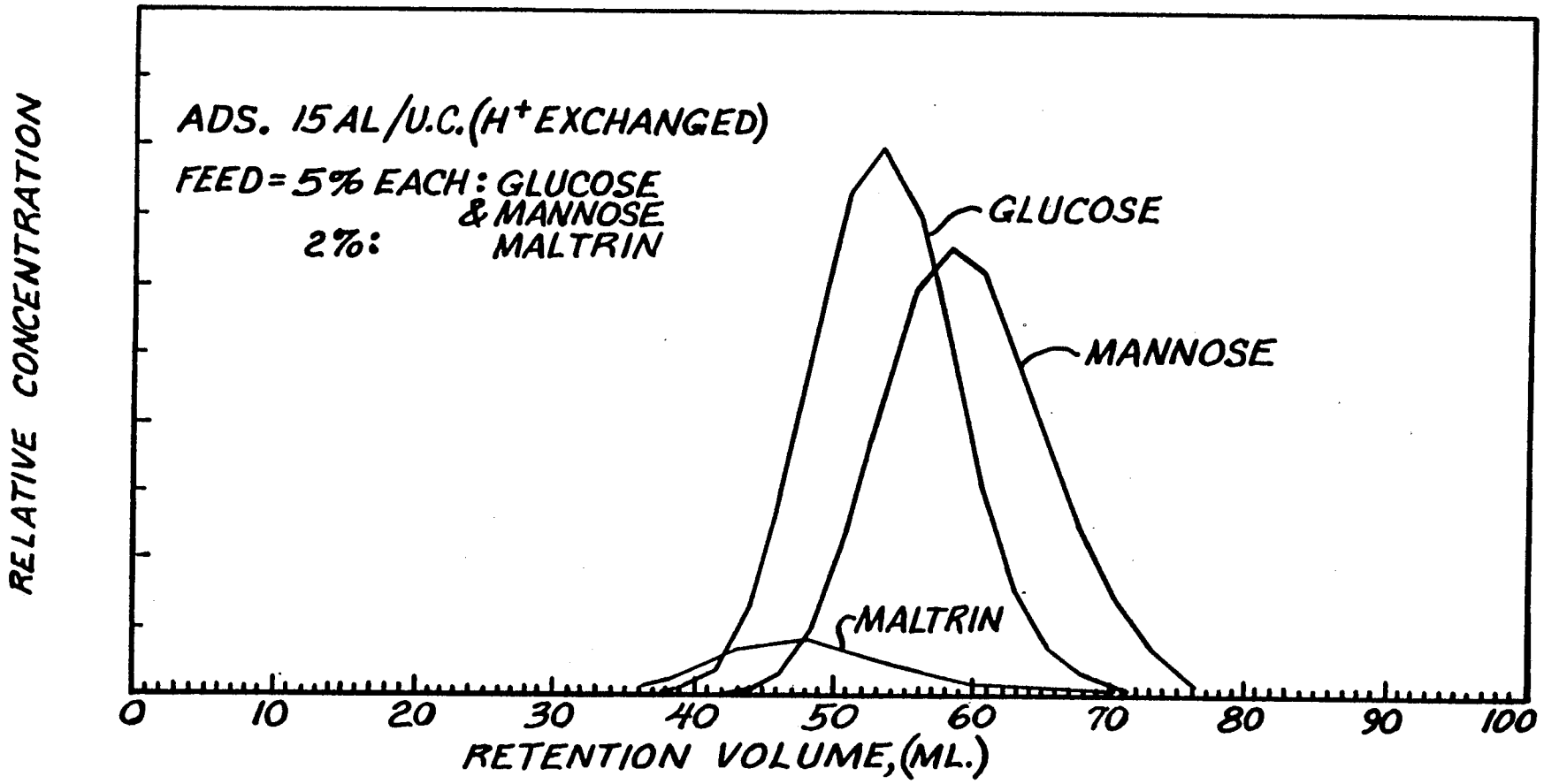

Example I was repeated except that the faujasite (US-Y #7) had 15 aluminum atoms per unit cell and was $H^+$ exchanged. β-M/G was 2.1. Resolution was 0.44. The pulse test results are shown in FIG. 6.

EXAMPLE VII

Figure 7:
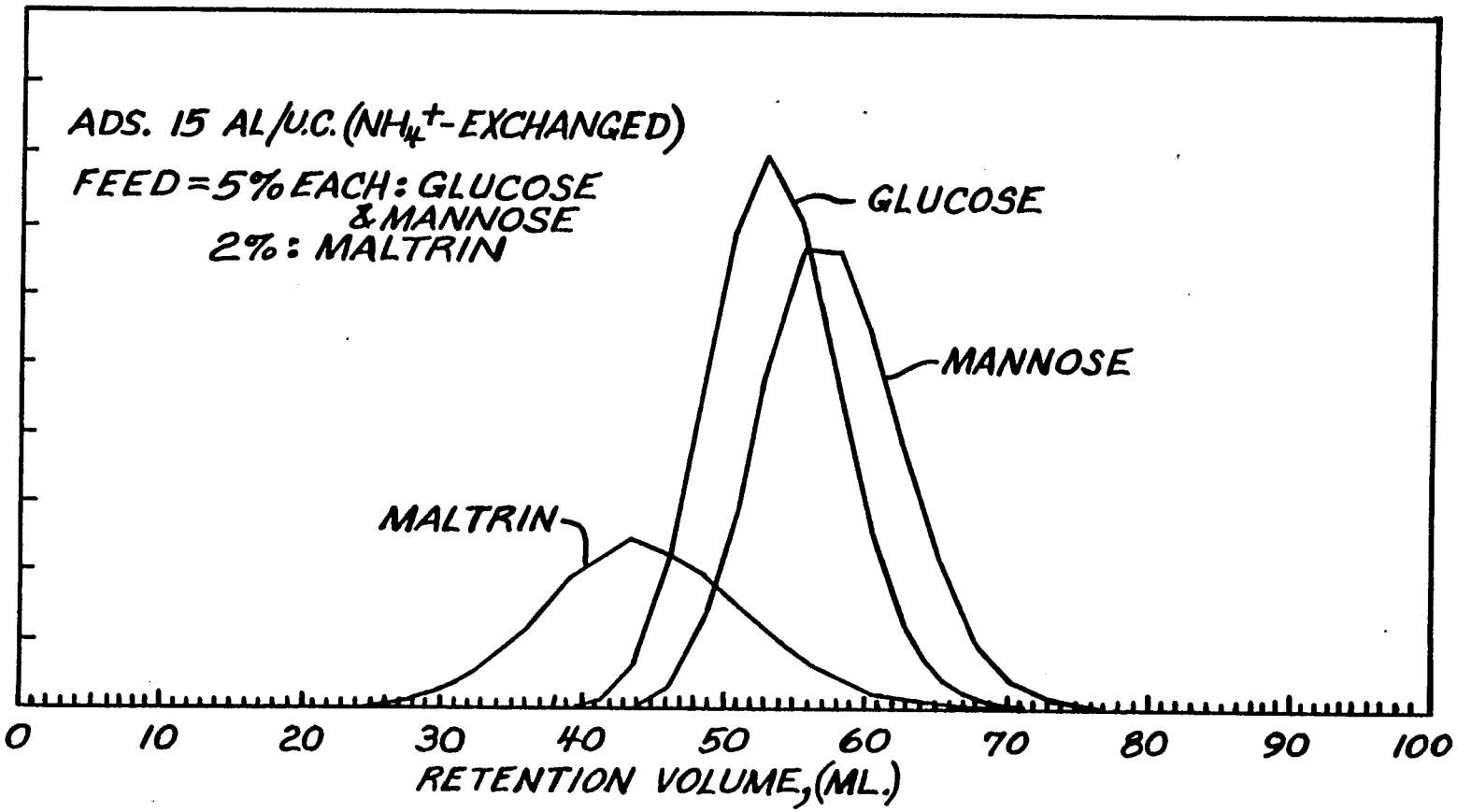

Another pulse test was run in the same manner as Example VI, except that the adsorbent (a dealuminated Y zeolite Toyo Soda US-Y #7 having 15 Al/UC) was in the $NH_4^+$ form, i.e., exchanged with ammonium ions. Other conditions were the same as in Example I. β-M/G was 1.44 and resolution was 0.35. The results of the pulse test are shown in the graph of FIG. 7 of relative concentration vs. retention volume. Thus, an effective separation was obtained in which the dealuminated Y zeolite was exchanged with an ammonium ion (which is inoperative according to the disclosures in both U.S. Pat. Nos. 4,471,114 and 4,394,178), again showing the unexpected advantage over this prior art for applicant's non-ion specific zeolitic separation.

EXAMPLE VIII

Figure 8:
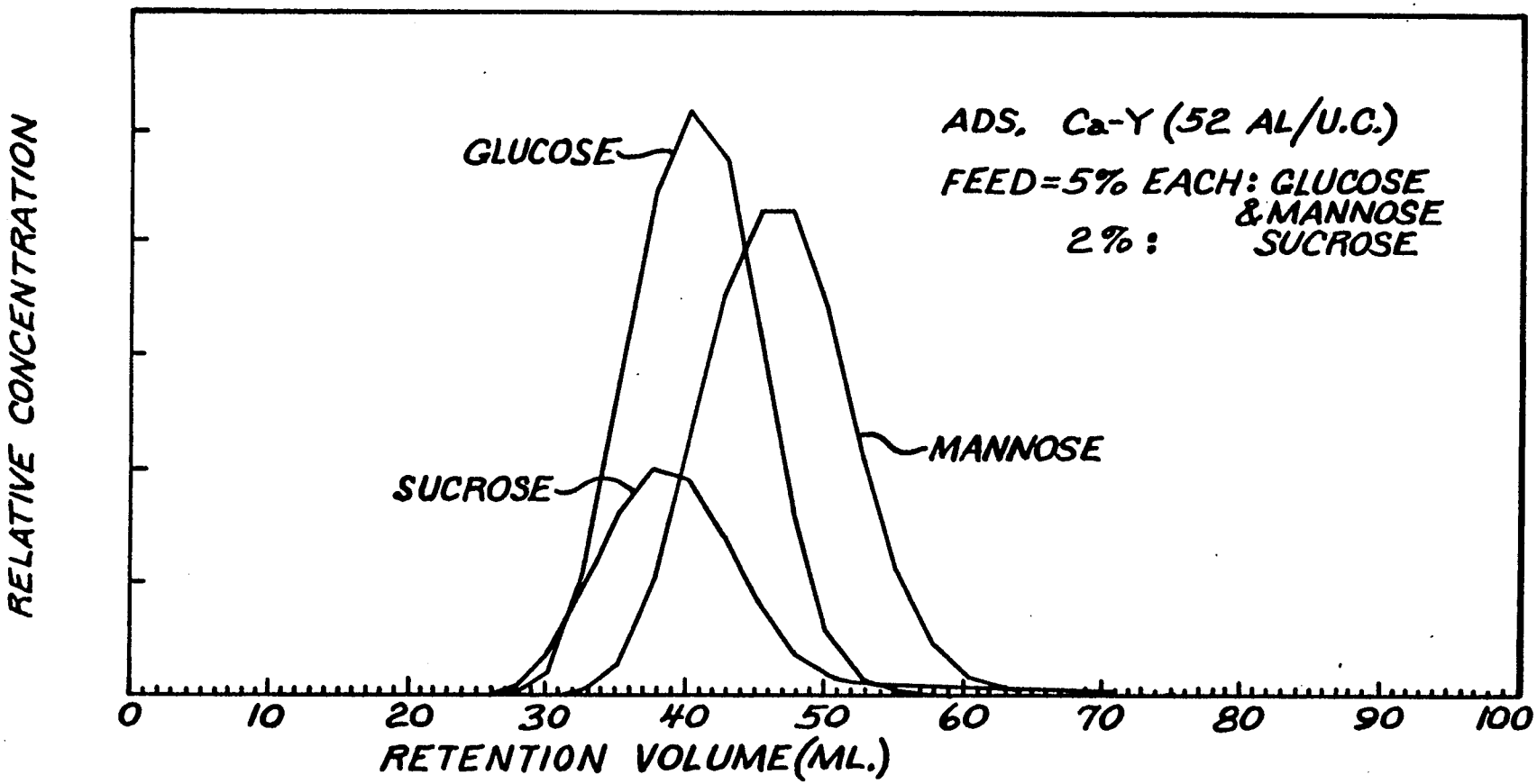
FIG. 8 (PRIOR ART)
FIG. 8 is a separation of glucose and mannose with a prior art zeolite.

Example I was repeated except that a prior art calcium-exchanged Y-faujasite (ADS-200-1, available from UOP) having 52 aluminum atoms per unit cell and calcium exchanged was used. The selectivity (β) of mannose relative to glucose was 3.8 and resolution between mannose and glucose was 0.47. However, the adsorbent must be regenerated during the process to replace the calcium lost or exchanged in the separation process. On the other hand, as seen from the results of Examples I–VI, when dealuminated faujasite having less than 50 Al/U.C. is used, the resolution and selectivity of the adsorbent is independent of the cation and, therefore, there is no reduction in performance due to loss or exchange of cation and it is not necessary to replace lost or replaced cations. The pulse test results for the prior art faujasite are shown in FIG. 8.

What is claimed is:

1. A process for separating glucose from a mixture of glucose and mannose which comprises contacting said mixture at adsorption conditions with an adsorbent comprising a dealuminated Y zeolite having about 5–20 aluminum atoms per unit cell, ion exchanged at exchangeable sites with a metal, ammonium or hydrogen ion, selectively adsorbing said mannose, removing the nonadsorbed portion of said mixture from contact with said adsorbent, thereby recovering high purity glucose, separating said mannose by desorption with a desorbent comprising water at desorption conditions.

2. The process of claim 1 wherein said adsorption and desorption conditions include a temperature range of from about 20° to about 100° C. and a pressure range of from about atmospheric to about 250 psig.

3. The process of claim 1 wherein said ions are selected from the group consisting of $H^+$, $Ca^{++}$, $NH_4^{++}$ and $Sr^{++}$.

4. A process for separating glucose from a mixture of glucose and mannose which comprises contacting said mixture with an adsorbent comprising a dealuminated Y zeolite having about 5–20 aluminum atoms per unit cell, ion exchanged at exchangeable sites with a metal, ammonium or hydrogen ion, selectively adsorbing said mannose, removing the nonadsorbed portion of said mixture from contact with said adsorbent and thereby recovering high purity glucose, and separating said mannose by desorption with a desorbent at desorption conditions.

5. The process of claim 4 wherein said ions are selected from the group consisting of $H^+$ and $NH_4^+$.

* * * * *